US005929728A

United States Patent [19]

Barnett et al.

[11] Patent Number: 5,929,728

[45] Date of Patent: Jul. 27, 1999

[54] IMBEDDED WAVEGUIDE STRUCTURES FOR A MICROWAVE CIRCUIT PACKAGE

[75] Inventors: Ronald J. Barnett, Santa Rosa, Calif.; Anthony R. Blume, Colorado Springs, Colo.

[73] Assignee: Hewlett-Packard Company, Palo Alto, Calif.

[21] Appl. No.: 08/882,460

[22] Filed: Jun. 25, 1997

[51] Int. Cl.[6] ..... H01P 3/12

[52] U.S. Cl. ..... 333/239; 333/247; 333/248; 29/600

[58] Field of Search ..... 333/239, 248, 333/246, 247; 29/600

[56] References Cited

U.S. PATENT DOCUMENTS

| | | | |
|---|---|---|---|
| 3,157,847 | 11/1964 | Williams | 333/239 |
| 3,938,244 | 2/1976 | Merle | 29/600 |
| 3,982,215 | 9/1976 | Lo et al. | 333/248 |
| 4,025,881 | 5/1977 | Cohen et al. | 333/248 |
| 4,439,748 | 3/1984 | Dragone | 29/600 |
| 4,918,049 | 4/1990 | Cohn et al. | 333/239 |
| 5,381,596 | 1/1995 | Ferro | 29/600 |
| 5,420,554 | 5/1995 | Gehrke | 333/235 |
| 5,583,468 | 12/1996 | Kielmeyer et al. | 333/33 |
| 5,600,286 | 2/1997 | Livingston et al. | 333/26 |
| 5,652,557 | 7/1997 | Ishikawa | 333/246 |

FOREIGN PATENT DOCUMENTS

| | | | |
|---|---|---|---|
| 1201946 | 8/1970 | United Kingdom | H01P 7/06 |
| 2109640 | 6/1983 | United Kingdom | H01P 3/00 |

OTHER PUBLICATIONS

U.S. application No. 08/690,118, filed Jul. 31, 1996 for Signal Distribution Structure Having Lossy Insulator of Ronald J. Barnett.

U.S. application No. 08/743,442, filed Nov. 1, 1996 for A Distributed Lossy Capacitive Circuit Element of Ronald J. Barnett.

U.S. application No. 08/743,444, filed Nov. 1, 1996 for Coaxial Connector For Mounting On A Circuit Substrate of Ronald J. Barnett.

Method for Fabricating Precision Waveguide Sections By Delmar Collenberger et al National Bureau of Stds Tech. Note, Jun. 1970.

*Primary Examiner*—Deborah Jones
*Assistant Examiner*—Cathy F. Lam

[57] ABSTRACT

A technique for forming imbedded microwave structures in a microwave circuit package is presented. In one method, windows are punched, stamped or molded into metal laminate plates. A metal laminate layer is formed by fusing each of the metal laminate plates one on top of another, preferably using a diffusion bonding technique. The metal laminate layer is fused on top of a metal base plate, which is adhered to a ceramic substrate, and a shielded cover is fused on top of the metal laminate layer to form the imbedded waveguide structure as the base plate, metal laminate plates, and cover plate are fused together. In another method, indented cavities are formed in a shielded cover. The shielded cover is then fused, preferably using a diffusion bonding technique, to a metal base plate, which is adhered to a ceramic substrate. The technique of the present invention may be used to form propagating waveguide structures which operate as transmission lines or resonant cavities, non-propagating waveguide structures which have extremely high cutoff frequencies and which are formed around microstrip transmission lines or microcircuitry to disallow energy below the cutoff frequency to propagate, a low cost, compact, efficient microcircuit-component-to-waveguide wire bond launch, and or a periscope-type waveguide in a microcircuit package.

22 Claims, 15 Drawing Sheets

IMBEDDED WAVEGUIDE STRUCTURES FOR A MICROWAVE CIRCUIT PACKAGE

FIELD OF THE INVENTION

The present invention relates generally to the field of microwave circuits, and more particularly to a method for fabricating imbedded waveguide structures in a microwave circuit package.

BACKGROUND OF THE INVENTION

In high-speed communications systems, microwave electromagnetic energy, or simply microwaves, (i.e., electromagnetic energy waves with very short wavelengths ranging from a millimeter to 30 centimeters) are typically used as carrier signals for sending information from one place to another. Information carried by microwaves is transmitted, received, and processed by microwave circuits.

Microwave circuits require high frequency electrical isolation between circuit components and between the circuit and the world outside the microwave circuit. Traditionally, this isolation has been obtained by building the circuit on a shim, placing the circuit inside a metal cavity, and then covering the cavity with a metal plate. The metal cavity itself is typically formed by machining or casting metal plates and bolting, welding, or sealing them together using solder or an epoxy. This approach suffers from several limitations. First, machining is expensive. Casting is less expensive but is less accurate and, accordingly, metal cavities built using the casting method tend to have larger dimensions. This may result in parallel leakage paths around the microwave circuit component if the dimensions of the cavity are such to allow electromagnetic energy to propagate near the component's operating frequency. A further limitation in the traditional methods of building metal cavities is that the method of sealing the metal cover to the cavity has been to use conductive epoxy. The epoxy provides a good seal, but it has a high resistance, which increases the loss of resonant cavities and leakage from shielded cavities. As a result, the traditional isolation method using a shielded cavity has not yielded expected shielding isolation success rates. Finally, the traditional methods for shielding microwave circuit components requires significant assembly time. Accordingly, it would be desirable to have an inexpensive method for imbedding precisely-dimensioned low-loss shielded cavities in a microwave circuit package without additional parts or assembly.

Signals are generally propagated and guided throughout a microwave circuit using transmission lines and waveguides, both of which are known in the art. Transmission lines may take many forms, including but not limited to coaxial, coplanar, and microstrip transmission lines. Waveguides are generally hollow and provide many advantages over the other forms of transmission lines, including a simpler hollow pipe construction which does not require an inner conductor or associated supports, and their low-loss and low heat dissipative characteristics.

As known by those skilled in the art, electromagnetic signals travel entirely within a waveguide, reflecting off its inner surfaces according to the freespace wavelength $\lambda$ of the signal. In order for a signal to propagate inside the waveguide, the cross-sectional width of a waveguide must be greater than $\lambda/2$ of the dominant mode. The cross-sectional width $\lambda_c/2$ of the waveguide determines what the cutoff frequency $f_c$ is, where $\lambda_c$ is the wavelength associated with the cutoff frequency $f_c$. When the freespace wavelength $\lambda$ is long, it is low in frequency and approaches the $\lambda_c/2$ dimension of the waveguide. When the cross-section width of the waveguide $\lambda_c/2$ is less than $\lambda_c/2$, the signal cannot propagate down the guide, and thus the waveguide acts as a high-pass filter in that it passes all frequencies above a critical or cutoff frequency $f_c$.

Resonant cavities may be used to build microwave filters. A resonant cavity is a dielectric region completely surrounded by conducting walls. It is capable of storing energy and is analogous to the low-frequency LC resonant circuit. The resonant cavity is an essential part of most microwave circuits and systems. Every enclosed cavity with a highly conducting boundary can be excited in an infinite sequence of resonant modes. The frequencies at which resonance occurs depend upon the shape and size of the enclosed cavity. When a resonant cavity is placed along a transmission line, energy is coupled into the cavity at resonance and is reflected at other frequencies. A combination of resonant cavities in series with transmission line input and output couplers can be made to provide almost any kind of desired filter or response.

As with the shielding cavities described previously, waveguide structures and resonant cavities are traditionally formed by machining or casting metal parts, and then bolting, welding, soldering or using epoxy to fasten them together. This process is costly both in terms of the time and expense of forming each part and also in the assembly time required to put them together. Accordingly, it would be desirable to provide an inexpensive method for forming imbedded waveguide structures precise dimensions in a microwave circuit package which does not require an expensive fabrication and assembly of a lot of parts.

SUMMARY OF THE INVENTION

The present invention provides an elegant solution to the above-mentioned limitations in the prior art with a novel low-cost technique for fabricating imbedded low-loss waveguide structures in microwave circuit packages without the necessity of fabricating and assembling a plethora of component parts. The technique of the invention may be used to build both propagating or non-propagating waveguides of precise dimensions. In one embodiment, an indented cavity is formed in the bottom plane of a metal cover plate. The bottom plane of the cover plate is then fused to a metal base plate, preferably using a direct fusion technique such as diffusion bonding, or alternatively by soldering or by using a highly conductive adhesive. An imbedded shielded cavity is formed when the cover plate and the base plate come together—that is, at the time the plates are laminated. The fusion technique is preferably a form of direct fusion, such as diffusion bonding, which is a high-temperature, high-pressure direct bonding technique. The fusion material must be a highly-conductive material in order to ensure that the cavity which is formed by fusing the cover to the ground plane is low-loss. The imbedded waveguide structure formed using the method of the present invention may be used to form a microcircuit-component-to-waveguide launch. This is accomplished by extending a wire bond loop, which is attached from a microcircuit component inside the microwave circuit package, to a wall of the imbedded waveguide structure. The wire bond loop formed in this way couples the energy from the microcircuit component into the imbedded waveguide structure, and vice versa. This wire bond launch can be bonded at the same time other normal assembly bonding takes place, and therefore does not take an additional process step. In addition, the present invention may be used to form an internal-waveguide-to-external-microwave-component launch. This is accomplished by forming a window which has the dimensions of a receiving opening of an external waveguide component in the roof, floor, or wall of the imbedded waveguide structure, and which extends from the inside of the imbedded waveguide structure through to the outside of the microwave circuit package. The window acts as a port for an external waveguide component. External waveguide components may be bolted, or fused using highly conductive material, to the microwave circuit package in a position where the receiving opening of the external waveguide component and the window are aligned.

In another embodiment, one or more windows are formed in one or more metal laminate plates using a punching or stamping method. Each metal laminate plate may be formed with similar or different window patterns. Each of the metal laminate plates, if more than one exist, are then fused together with highly conductive material, one on top of another, preferably using a direct fusion technique such as diffusion bonding. Windows in successive metal laminate plates may or may not overlap, depending upon the desired waveguide structure path as determined by the punched patterns in each of the various successive metal laminate plates. Complex waveguide structures may be designed to run in any direction or shape, whether the path is parallel to the plane of a given metal laminate plate or through one or more metal laminate plates, by careful design of the shape and alignment position of the punched patterns in each of the successive metal laminate plates. In addition, a wire bond loop which is coupled to a microcircuit component that is contained within the fused metal laminate plates may be extended into the imbedded waveguide structure to form a microcircuit-to-waveguide launch. Also, one or more windows which match the dimensions of a receiving openings of external waveguide components may be formed to extend from inside an imbedded waveguide structure to the outside of the fused metal laminate plates to form an internal-waveguide-to-external-waveguide-component launch. An external waveguide component may then be bolted or fused using highly conductive material to the fused metal laminate plates in a position where the receiving opening of the external waveguide component and the window are aligned.

The technique of the present invention allows an imbedded waveguide structure to be formed as the ceramic substrate comes together with the metal laminate. No individual waveguide structure parts need to be fabricated and then assembled. Instead, the imbedded waveguide structures are formed naturally as the ceramic substrate is brazed to the metal laminate.

The technique of the present invention may be used for several important purposes. First, waveguide structures can be formed within the fused metal laminate layers to operate as transmission lines and thus to propagate signals. Second, waveguide structures may be designed to have an extremely high cutoff frequency and can be formed around microcircuit components including quasi-coplanar microstrip transmission lines to disallow electromagnetic energy below the cutoff frequency to propagate, and thereby to significantly reduce parallel path leakage around the microcircuit components. In addition, the technique of the present invention may be used to implement a low-cost, compact, efficient microcircuit-component-to-waveguide wire bond launch. The present invention may also be used to implement a periscope-type waveguide in a microcircuit package.

BRIEF DESCRIPTIONS OF THE DRAWINGS

The objects and advantages of the invention will become more apparent and more readily appreciated from the following detailed description of the presently preferred exemplary embodiment of the invention taken in conjunction with the accompanying drawings, of which:

DETAILED DESCRIPTION OF THE PRESENT INVENTION

Figure 1:
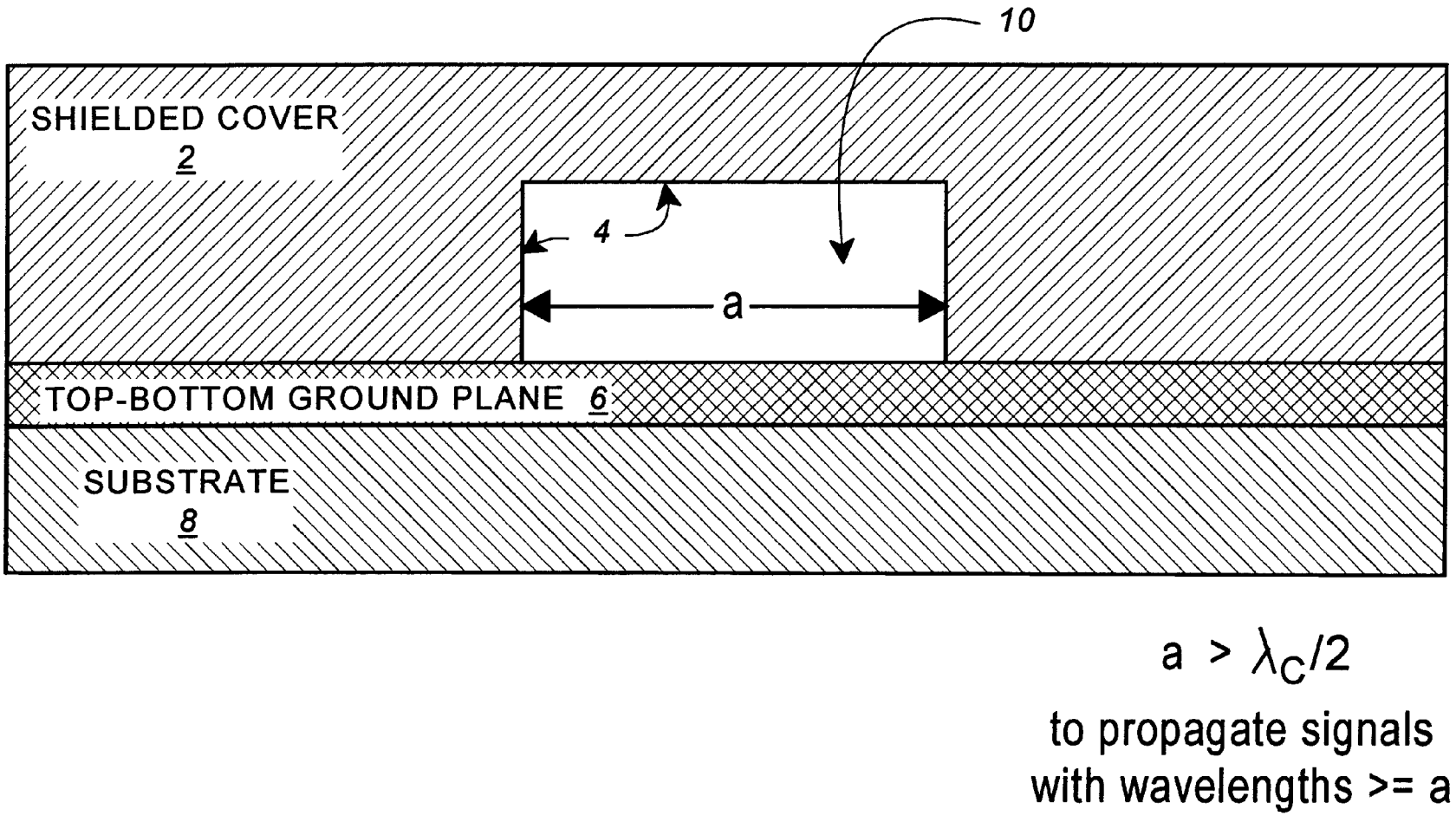
FIG. 1 shows a cross-sectional view of one embodiment of an imbedded waveguide structure, formed by fusing a metal cover having an indented cavity therein to a metal base plate, for a microwave circuit package of the present invention.
Figure 2:
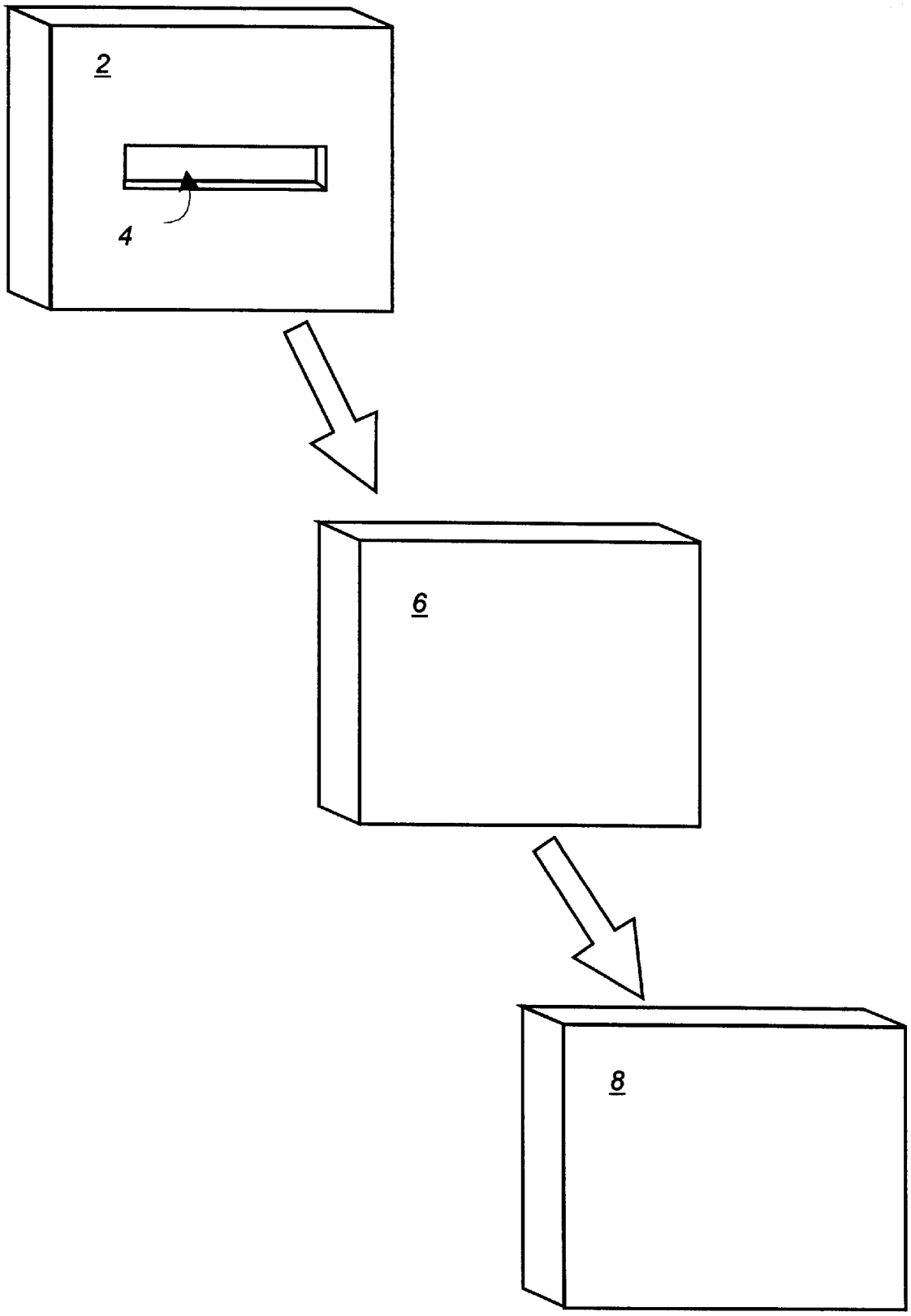
FIG. 2 is an assembly view of the imbedded waveguide structure of FIG. 1.

FIG. 1 is a cross-sectional view of one embodiment of an imbedded waveguide structure 10 for a microwave circuit package of the present invention. A shielded cover 2 plated with a highly conductive material such as gold, silver or copper has an indented cavity 4 formed into its bottom plane. The indented cavity 4 may be formed by machining, casting, coining or any similar means. The indented cavity is constructed to have a width dimension of greater than $\lambda_c/2$, where $\lambda_c$ is the wavelength of the lowest frequency to be propagated by the waveguide. The $\lambda_c/2$ dimension is important because any electromagnetic energy having a frequency below the cutoff frequency $f_c$ will not propagate. The bottom plane of the shielded cover 2 is fused or laminated to the top of a highly conductive metal base plate 6, preferably made of or plated with gold or silver. The shielded cover 2 and base plate 6 are preferably fused using a direct fusion technique such as diffusion bonding, described hereinafter. The bottom plane of the base plate 6 is adhered with an adhesive such as conductive epoxy to a ceramic or organic laminate (e.g., a printed circuit board) substrate 8. FIG. 2 is a perspective view of the shielded cover 2 with indented cavity 4, base plate 6, and substrate 8, illustrating the assembly of the integrated waveguide structure.

As used hereinafter, the term "fused" is preferably achieved using a form of direct fusion such as diffusion bonding. Diffusion bonding is a high-temperature, high-pressure direct bonding process. Diffusion bonding may be accomplished by pressing two metal surfaces together using high pressure at a temperature approximately ¾ of the melting temperature of the metal for a period of time. Over that period of time, the metal molecules diffuse together at the interface surface such that the two metal pieces become one. For example, two copper plates can be diffusion bonded by placing them one on top of another in a hot press of approximately 850° C. (copper melts at 1083.4° C.) and applying 1200 lbs. per square inch for about an hour. With diffusion bonding, the metal plates do not melt; rather, the metal becomes soft and the molecules at the interface are brought close enough together with enough energy to form a solid molecular bond. In the preferred embodiment, diffusion bonding is accomplished by coating the metal plates with 100 to 150 microinches of silver, which has the highest electrical conductivity of all the metals, and then applying 35 to 50 microinches of tin on one of the surfaces that is to be bonded together. The silver-tin combination forms a eutectic such that, even though silver normally melts at 961.93° C., in the silver-tin combination, it melts together with the tin at approximately 220° C. This provides a manufacturing advantage in that the metal plates can be bonded together at a lower temperature of approximately 300° C., thus reducing manufacturing costs by requiring less energy to heat up and increasing manufacturing throughput due to the reduced time it takes for the parts to cool down. Furthermore, the high conductivity of silver is nearly attained because during the diffusion bonding process, the tin diffuses into the silver layer such that only a small percentage of tin is mixed with the silver at the surface.

Although the diffusion bonding technique described above is the preferred fusion process for fusing metal plates together in the present invention, fusion may alternatively be accomplished by soldering, using a highly conductive epoxy, or any other such effective means.

Figure 3:
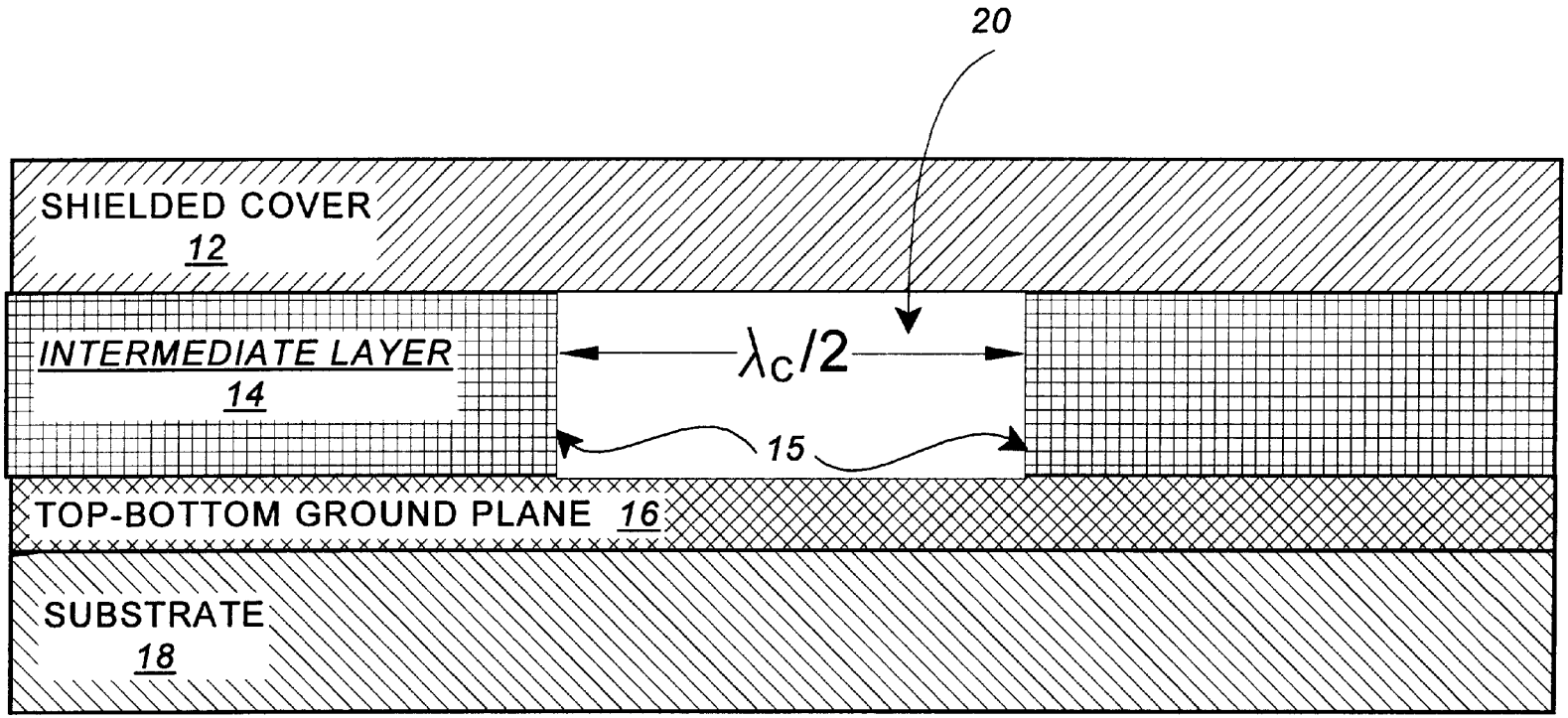
FIG. 3 is a cross-sectional view of a second embodiment of an imbedded waveguide structure, formed using a stamp-and-layer method, for a microwave circuit package of the present invention.
Figure 4:
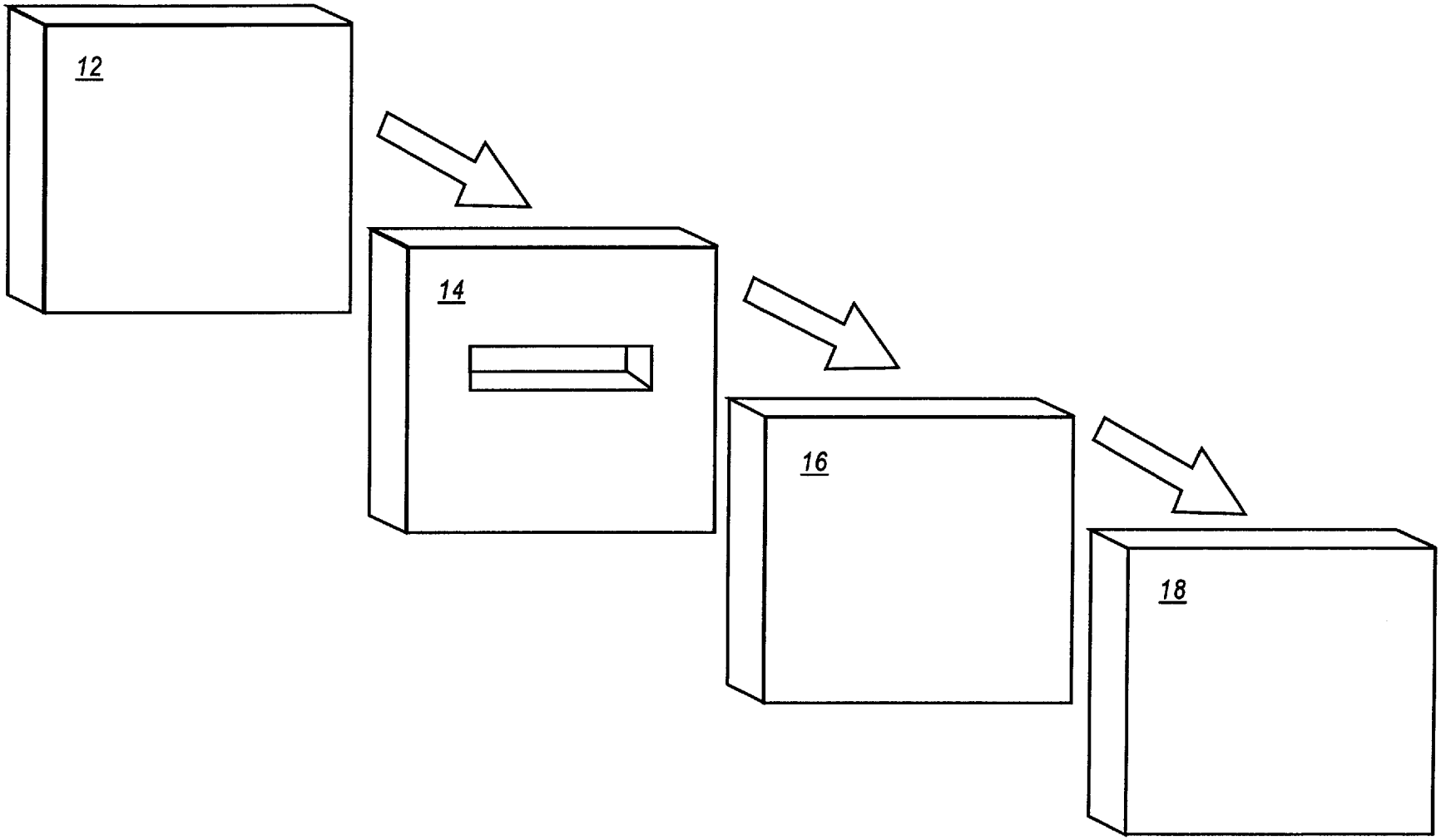
FIG. 4 is an assembly view of the imbedded waveguide structure of FIG. 3.

FIG. 3 is a cross-sectional view of a second embodiment of an imbedded waveguide structure 20 for a microwave circuit package of the present invention. A shielded cover 12 made of or plated with highly conductive material such as gold or copper is fused or laminated to a top plane of a metal laminate plate 14. An open window 15 is disposed in the metal laminate plate 14 to create a thruway between the top and bottom plane of the metal laminate plate 14. The window 15 may be formed using techniques such as molding, punching, stamping, or any other means. The window 15 is constructed such that the cross-sectional width dimension of the waveguide structure which is formed therein is greater than $\lambda_c/2$, where $\lambda_c$ is the wavelength of a desired cutoff frequency $f_c$. The cross-sectional width dimension may be the length or width of the window, or it may be the thickness of the metal laminate plate which forms the walls of the imbedded waveguide structure. The bottom plane of the metal laminate plate 14 is fused or laminated to the top of a metal base plate 16, preferably using the diffusion bonding technique described previously. The bottom plane of the base plate 16 is then adhered to a substrate 18. Due to the differences in the coefficients of thermal expansivity (CTE) between metal and ceramic, the metal base plate 16 is preferably adhered to the ceramic substrate 18 using an adhesive such as an epoxy. FIG. 4 is a perspective view of the shielded cover 12, metal laminate plate 14, base plate 16, and substrate 18, illustrating the assembly of the integrated waveguide structure.

In both of the embodiments shown in FIGS. 1–4, the base plates, shielded covers, metal laminate plates, and, if used, adhesive material (i.e., solder, epoxy, etc.), must comprise a highly conductive material. The material chosen must be conductive at the frequencies of the electromagnetic energy that is desired to propagate or isolate, or leakage will occur.

The uses of the imbedded waveguide structure of the present invention are multifold. These imbedded waveguide structures are highly conductive cavities formed within a microwave circuit package which can be used as waveguide transmission lines, shielding cavities for microcircuit components and microstrip transmission lines, and resonant cavities for use in passband and stopband filtering. A novel microcircuit-to-waveguide launch may also be formed using the imbedded waveguide structure of the present invention, as well an angle-bend or "periscope"-type waveguide. A combination of different imbedded waveguide structures formed for different purposes also may be formed. Furthermore, it will be appreciated that any complex structure may be formed within a microwave circuit package at the time that the metal cover and/or metal laminate plates and/or metal base plate are fused together.

In its very basic use, the imbedded waveguide structure of the present invention may be used as a waveguide—that is, to propagate electromagnetic energy through the microwave system contained in the microwave circuit package. When the imbedded waveguide structure is to be used as a waveguide filter, greater precision is required to ensure that the resonant cavities are at the correct frequency. Accordingly, the punch and layer method, which is more precise than molding and less expensive than machining, is the preferred method of construction.

Figure 5:
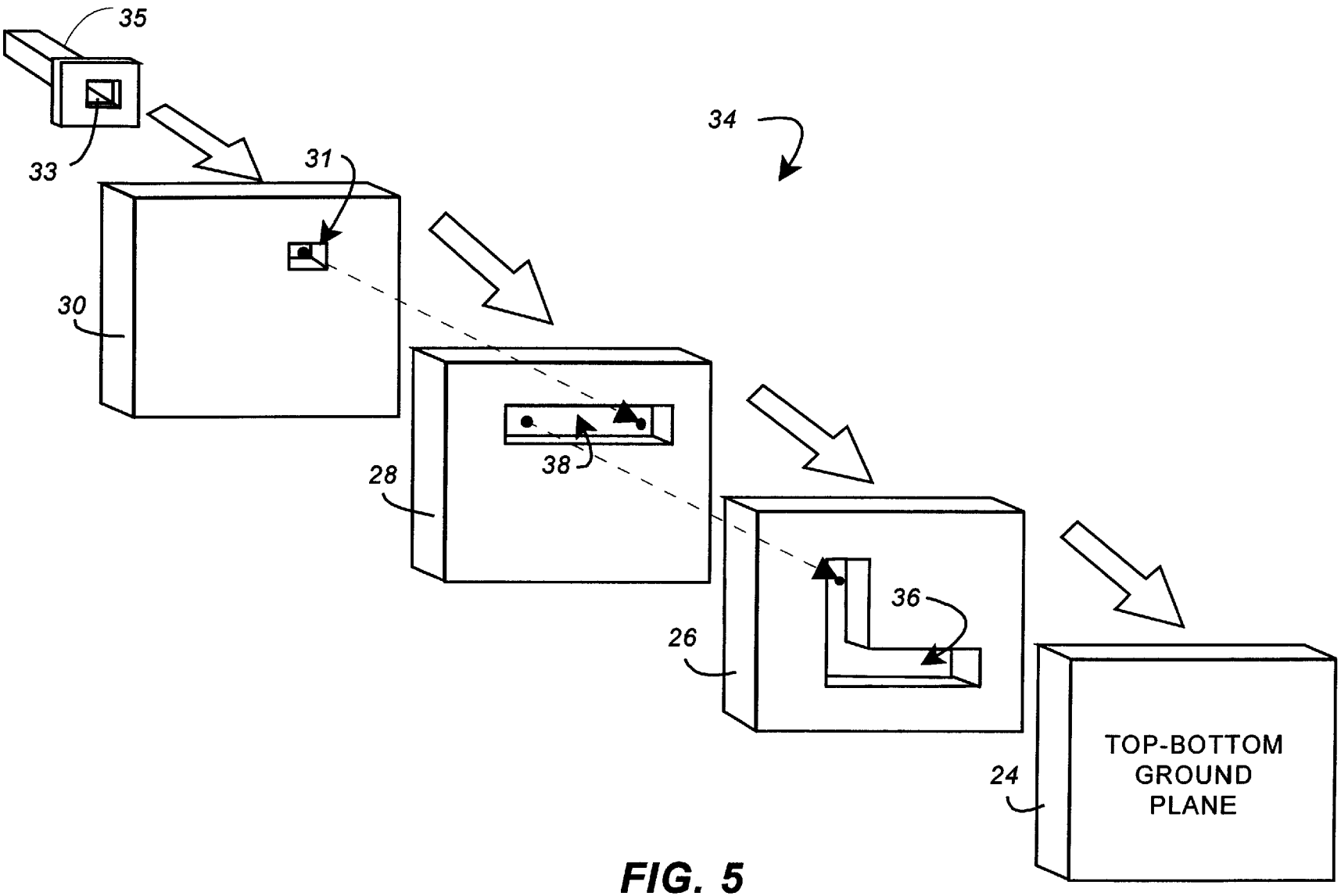
FIG. 5 is an assembly view of a multiple-layer-laminate microwave circuit package which illustrates how the technique of the present invention may be utilized to construct non-planar "periscope"-type imbedded waveguide structures.
Figure 6:
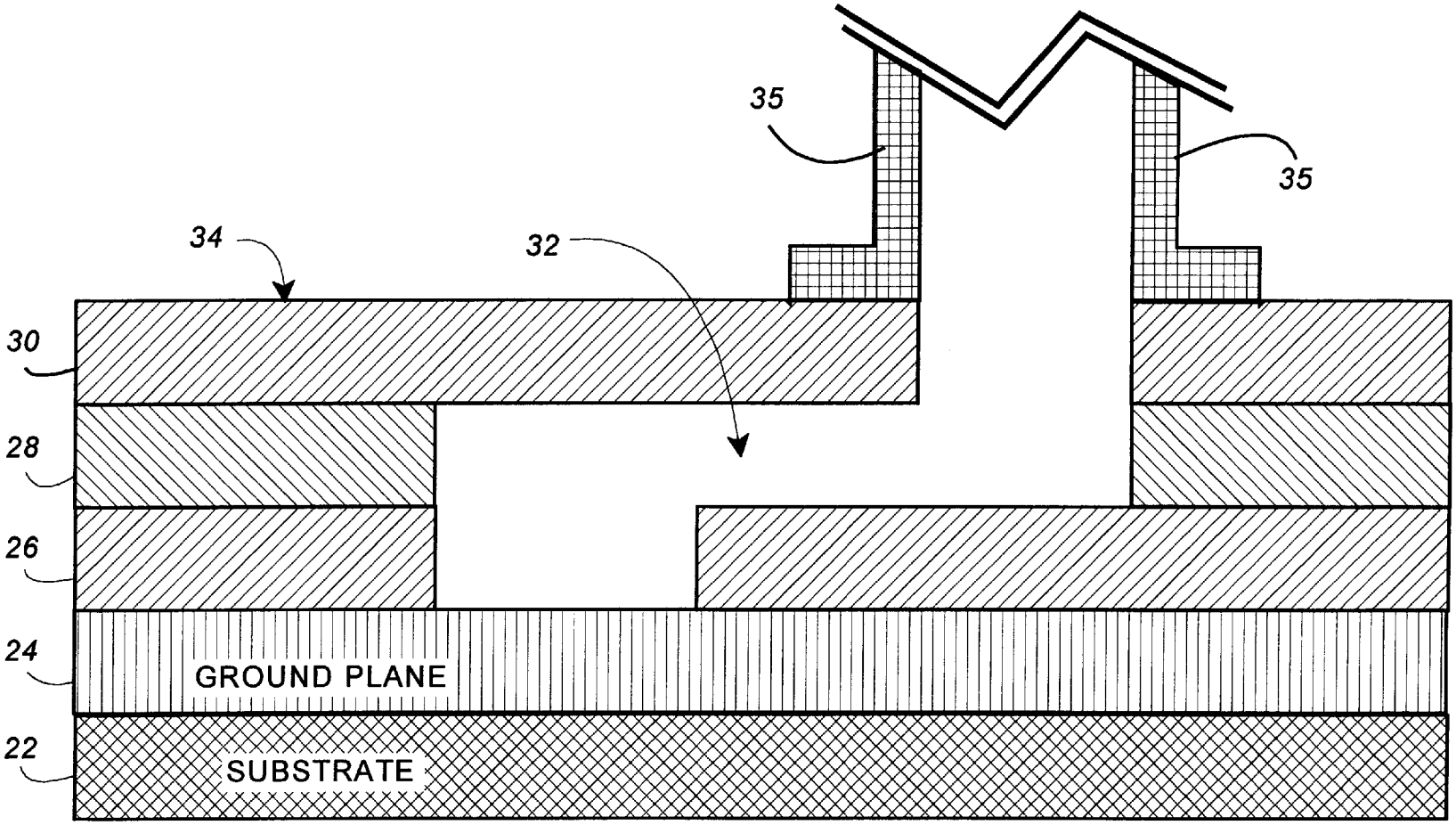
FIG. 6 is a cross-sectional view of the microwave circuit package of FIG. 5.
Figure 7:
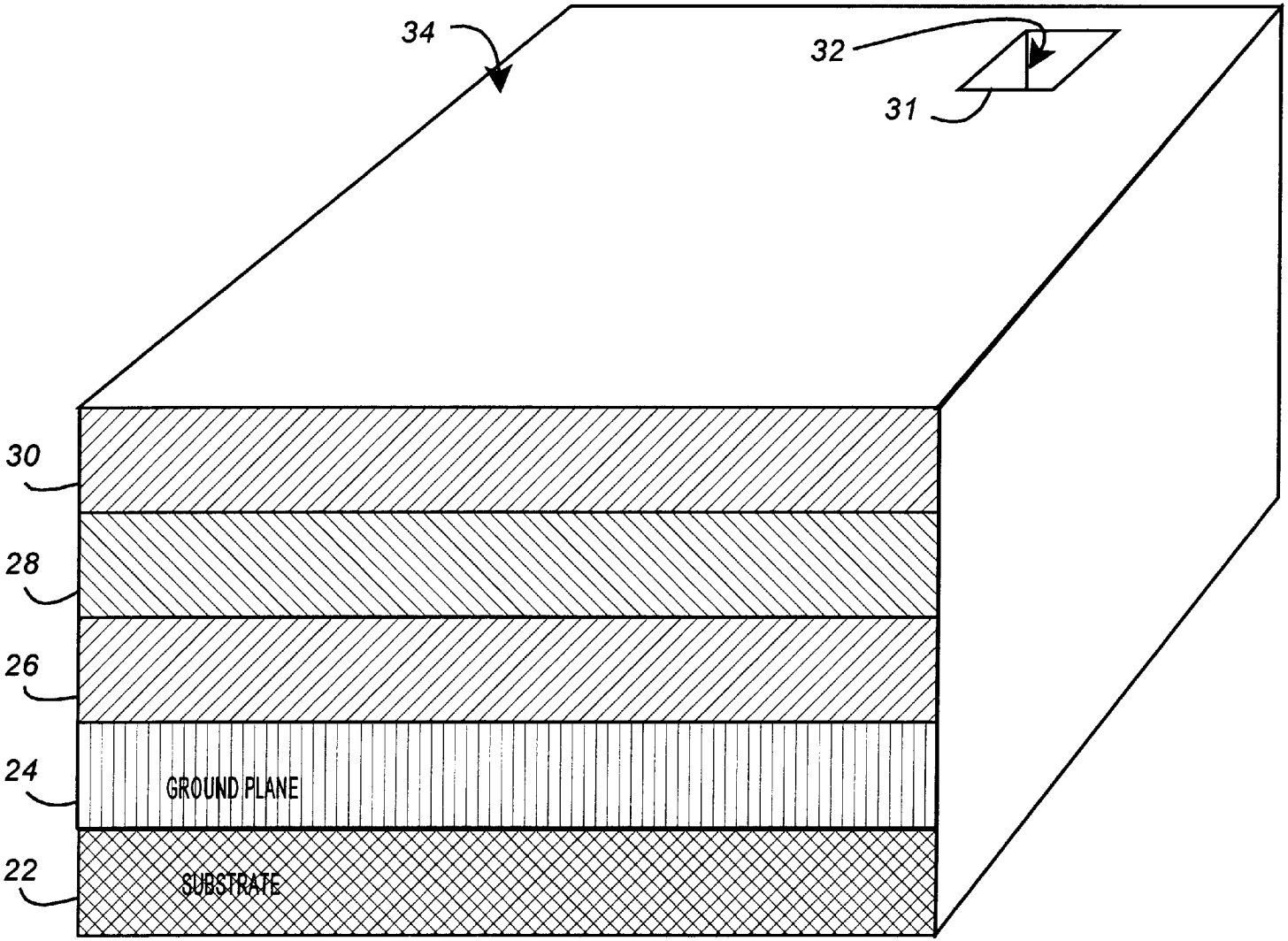
FIG. 7 is a top view of the microwave circuit package of FIGS. 5 and 6.

Additionally, the punch and layer method allows the waveguide structure to take on the form of a non-planar structure when more than one intermediate metal planar layer is utilized. FIG. 5 is an assembly view of a multiple-layer-laminate microwave circuit package 34 which illustrates how the technique of the present invention may be utilized to construct complex waveguide structures in any direction, such as a non-planar "periscope"-type imbedded waveguide structure. As shown in FIG. 5, the multiple-layer-laminate microwave circuit package 34 comprises a plurality of metal laminate plates 26, 28. Each metal laminate plate 26, 28 may include one or more windows which form a thruway between the top and bottom plane of the respective metal laminate plate. To construct a non-planar "periscope"-type waveguide, one metal laminate plate is formed to have a window which, at fusion time, aligns with at least a portion of a window of a successive metal laminate plate. Thus, in FIG. 5, a base plate 24 is fused to the bottom plane of metal laminate plate 26 to form the first layer floor of the periscope-type waveguide. The metal laminate plate 26 is formed with open window 36. The window 36 may be shaped in a right-angle bend as shown, or may be formed in any other suitable shape as desired for the particular microwave system under design. For example, the shape of window 36 may be a rectangle or right-angle bend used for straight-through coupling from one laminate plate layer to another, or it may be circular, oval, triangular, or any other shape to form an aperture for coupling signals from one cavity in a layer above to another cavity in a layer below, or vice versa. As also shown in FIG. 5, the successive metal laminate plate 28 is formed with open window 38, again in any desired shape suitable for the application at hand, in a position such that when the bottom plane of metal laminate plate 28 is aligned and fused to the top plane of metal laminate plate 26, a portion of window 36 overlaps a portion of window 38. The alignment is typically achieved by putting tooling holes through the laminate plates and inserting guide pins through the tooling holes via the laminating press. The non-window portion of metal laminate plate 26 which overlaps window 38 of successive metal laminate plate 28 forms the second layer floor of the waveguide when the metal laminate plates 26 and 28 are fused together. Similarly, the non-window portion of metal laminate plate 28 which overlaps window 36 of metal laminate plate 26 forms the first layer roof of the periscope-type waveguide when the metal laminate plates 26 and 28 are properly aligned and fused together. A shielded cover 30 is fused to the top plane of metal laminate plate 28 to form the second layer roof of the imbedded periscope-type waveguide. A window 31 having the dimensions of a receiving end 33 of an external waveguide component 35 may be formed in the shielded cover 30 in a position of alignment with the window 38 in metal laminate plate 28 to allow an external waveguide component 35 to be bolted or fused to the top plane of the shielded cover 30 and thereby eliminate the need for an expensive and bulky microwave-package-to-external-waveguide-component adapter. The external waveguide component 35 may be a waveguide, an antenna, a horn, or any other waveguide system component. Again, each layer must be formed of a material such that when fused together, every internal surface of the imbedded waveguide, including the epoxy or solder, is highly conductive. FIG. 6 is a cross-sectional view of the microwave circuit package 34 of FIG. 5 illustrating the non-planar imbedded periscope-type waveguide structure 32 formed using the technique of the present invention. FIG. 7 is a top perspective view of the microwave circuit package 34 of FIGS. 5 and 6, which illustrates the substrate 22, metal base plate 24, metal laminate plates 26, 28, and shielded cover 30 fused together. FIG. 7 also illustrates the window 31 formed in the shielded cover 30 which has dimensions which match that of the receiving end 33 of external waveguide component 35. The external waveguide component 35 may be attached directly to the microwave circuit package 34 by bolting, soldering, or direct fusion, where the opening of the standard external waveguide component aligns with the window 31 in the shielded cover 30.

Figure 8:
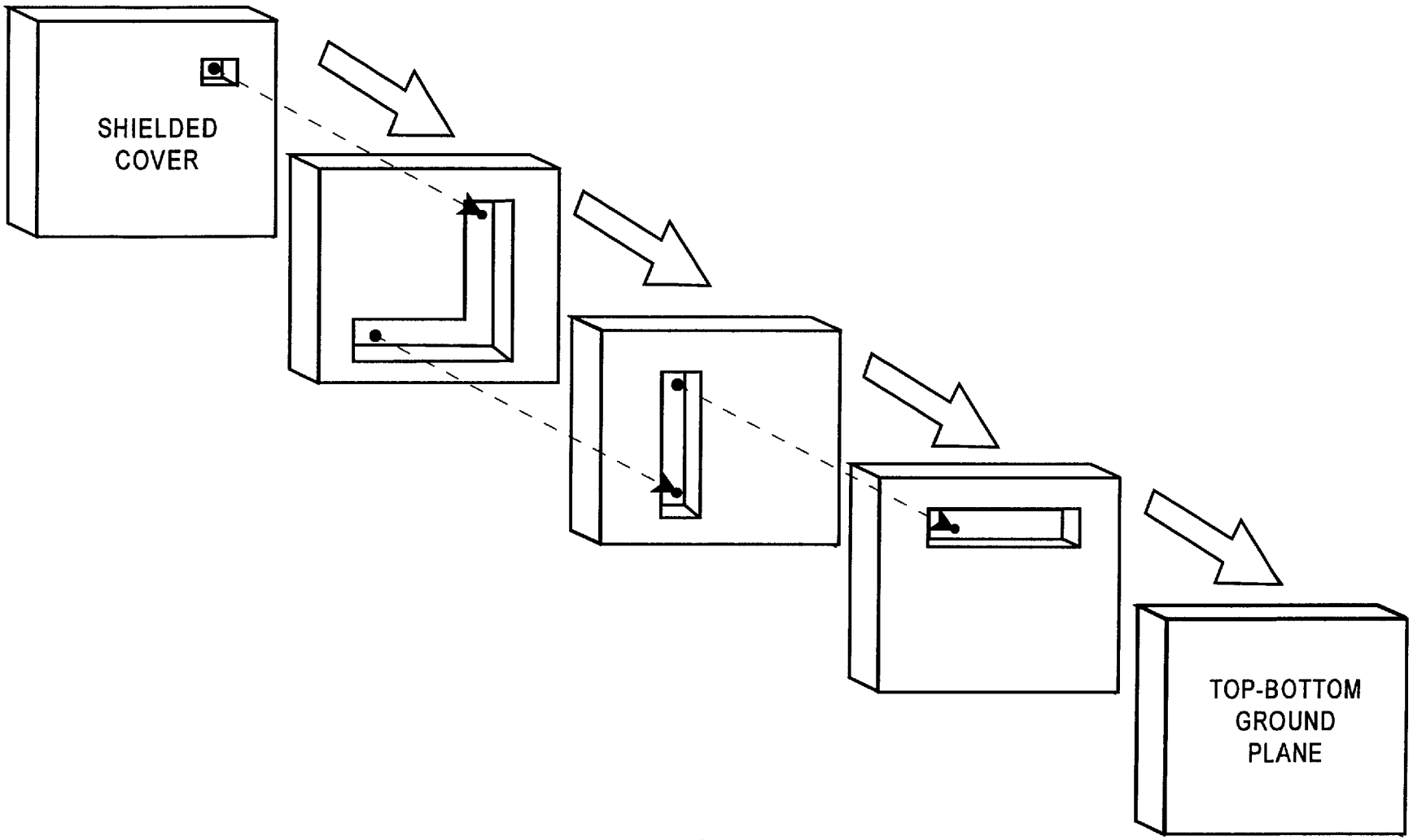
FIG. 8 is an assembly view of an alternative example configuration which is used to illustrate a different waveguide path and more metal laminate plates.
Figure 9:
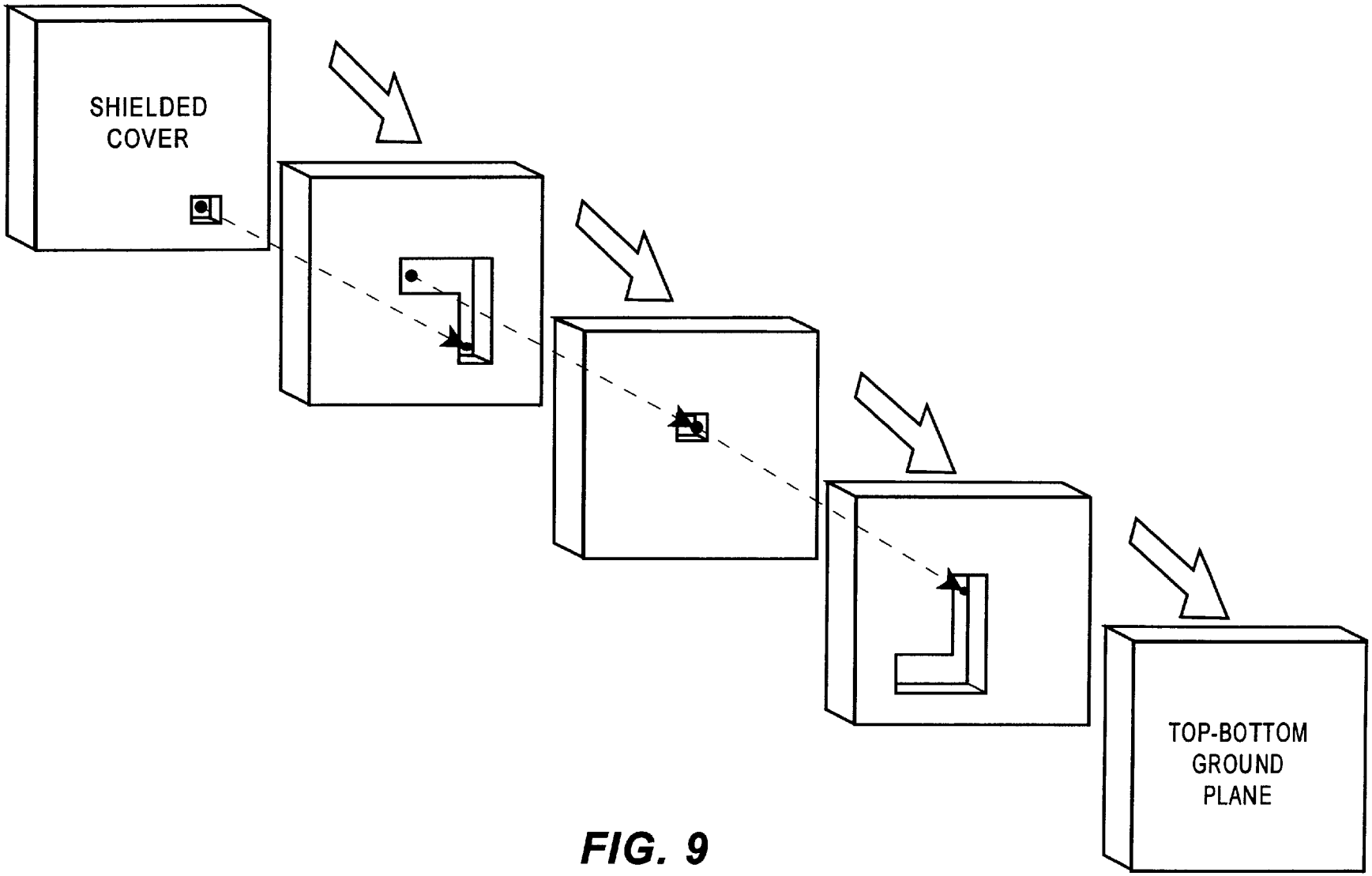
FIG. 9 is an assembly view of an alternative example configuration which is used to illustrate a different waveguide path and more metal laminate plates.

It is to be understood that the number of metal laminate plates utilized and the number of different waveguide structures that may be formed using the technique of the present invention are many, and will vary from one microwave circuit package application and design to another. The shape and form of the waveguide structure depends only upon the shapes, directions, and sizes of the windows which make up the window pattern in each metal laminate layer, metal base plate, and shielded cover. FIGS. 8 and 9 show alternative example configurations to illustrate different waveguide paths and more metal laminate plates. The technique of the present invention may be extended to construct any complex waveguide path, and the embodiments shown herein are not intended to be limiting.

Figure 10:
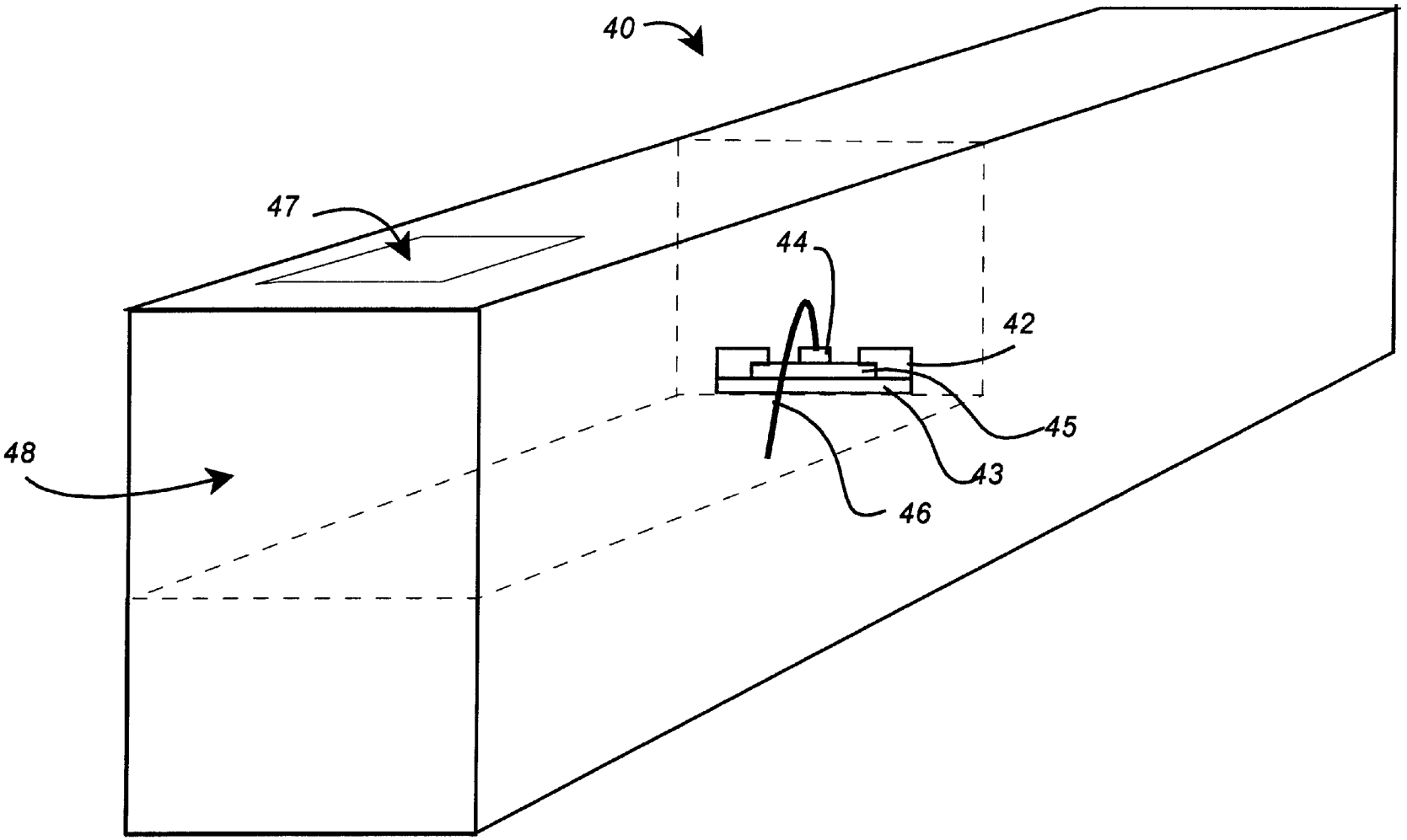
FIG. 10 is a perspective view of a microstrip-to-waveguide launch.
Figure 11:
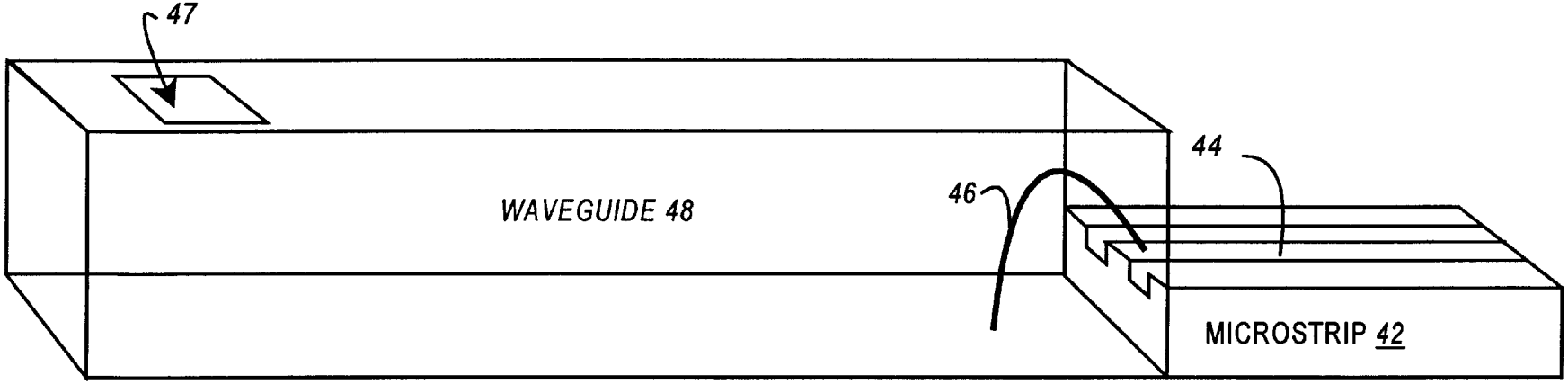
FIG. 11 is a side view of the microstrip-to-waveguide launch of FIG. 10.
Figure 12:
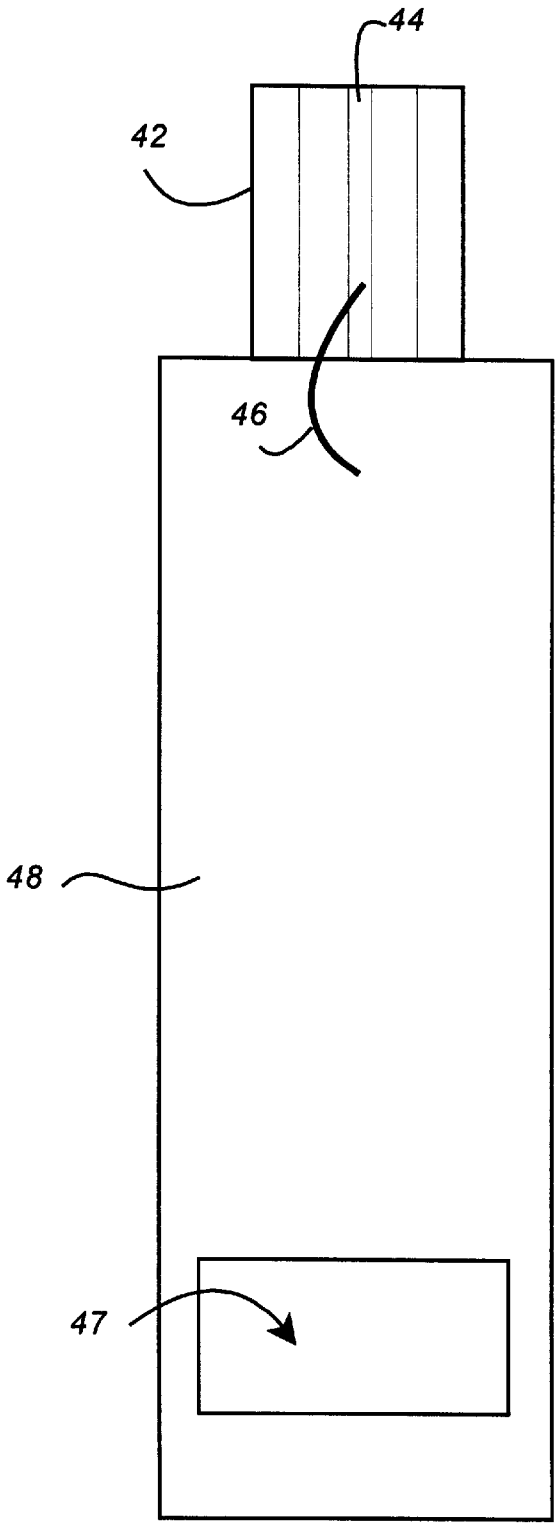
FIG. 12 is a top view of the microstrip-to-waveguide launch of FIGS. 10 and 11.

The present invention may also be used to construct a novel microcircuit-component-to-waveguide launch. FIG. 10 is a perspective view of the portion of a microwave circuit package 40 in which a microcircuit-component-to-waveguide launch is constructed, where the microcircuit component is a quasi-coplanar microstrip transmission line, hereinafter referred to as a microstrip. As shown in FIG. 10, a microwave circuit package 40 comprises a microstrip 42. The microstrip 42 is formed as follows: a ground plane is printed or fused onto a substrate to construct a base plate 43; a well-controlled (in thickness and dielectric constant) dielectric layer 45 is then applied to the top of the base plate 43; finally, a conductor 44 is applied to the top of the dielectric 45 to form the microstrip. As shown in FIG. 10, a wire bond loop 46 is attached via solder or other suitable means to the conductor 44 of the microstrip 42. A waveguide structure 48 is formed in the microwave circuit package 40 and positioned such that the wire bond loop 46 extends into one end of the waveguide structure 48. Flux linkages surrounding the wire bond loop 46 couple the transmission signal carried by the microstrip 42 to the waveguide 48 transmission line. FIG. 11 shows a side view of the microstrip-to-waveguide launch of the present invention. FIG. 12 shows a top view of the microstrip-to-waveguide launch. As mentioned earlier, the waveguide structure 48 may be formed to have an external opening 47. In FIG. 12, the external opening 47 is formed in the microwave circuit package cover, to which an external waveguide component may be directly aligned and attached. In will be clear to one skilled in the art that the same principles can be applied to couple a microwave signal from any other type of microcircuit component into a waveguide structure as well. Thus, a low-cost, compact, direct microcircuit-component-to-waveguide launch may be built using the techniques of the present invention. It will also be appreciated by one skilled in the art that the microcircuit-component-to-waveguide launch may be used to couple a microwave signal from an external microwave component, such as an antenna or external waveguide into an imbedded waveguide structure and then into a microcircuit component residing within the microwave circuit package. It was mentioned previously that the technique of the present invention may be applied to construct a non-propagating waveguide structure to provide high isolation between microwave circuit components, microwave signal paths, and microwave circuit components/signal paths and the world external to the microwave circuit package. These non-propagating waveguide structures may encase a microwave circuit component, such as a microcircuit or microstrip transmission line, and be designed with an extremely high cutoff frequency $f_c$ such that at frequencies below $f_c$, no electromagnetic energy is propagated in the waveguide structure. This technique may be use to significantly reduce parallel path leakage around a microcircuit component by ensuring that all of the electromagnetic energy within the imbedded waveguide structure is propagated through the microwave circuit component. Thus, by placing different microstrip transmission lines or microcircuitry in different non-propagating waveguide structures, excellent high frequency isolation is achieved between the lines and circuits as well as between the lines and circuits and the world external to the microwave circuit package.

Figure 13:
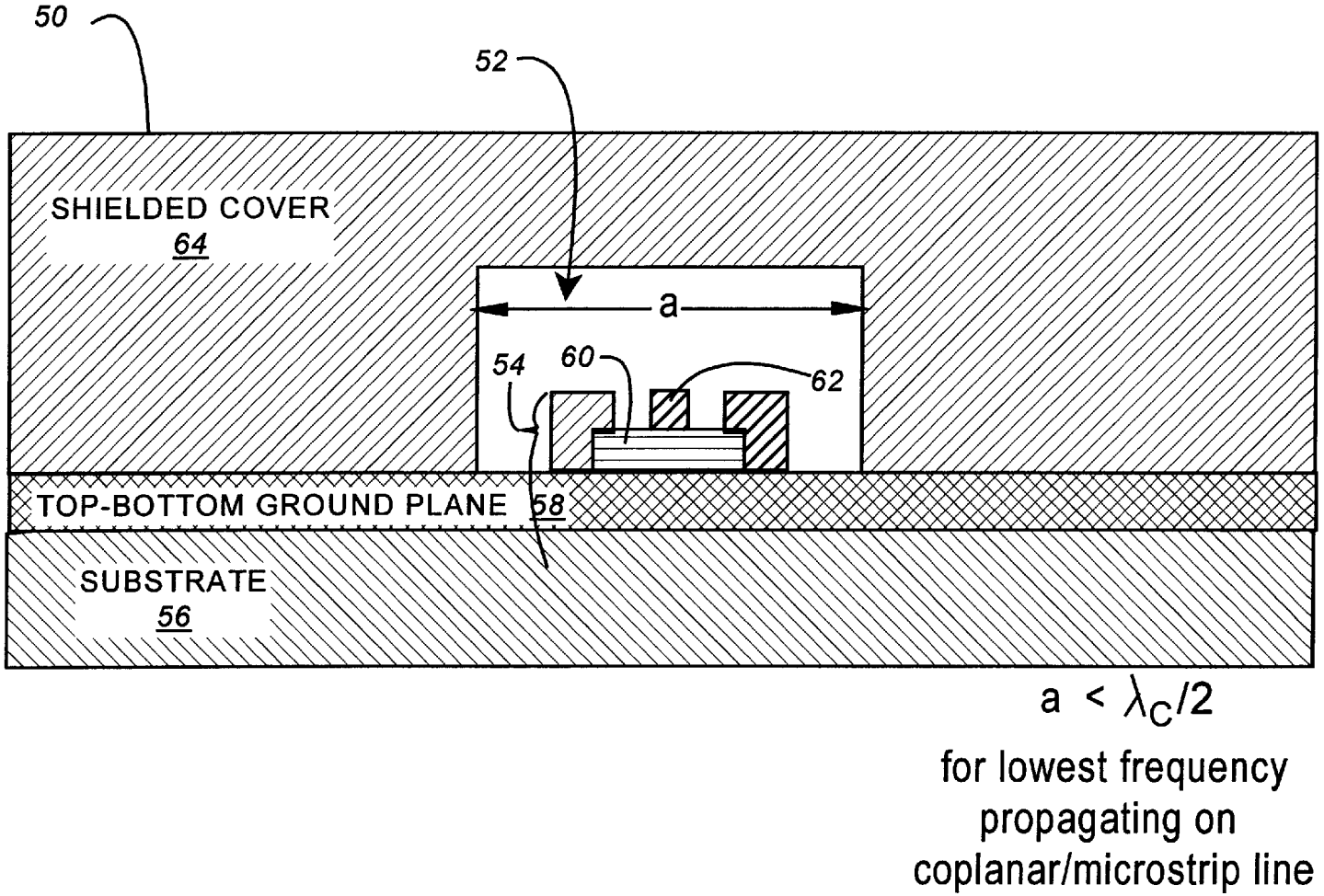
FIG. 13 is a cross-sectional view of an example non-propagating waveguide structure formed in a microwave circuit package which is used to shield a microstrip transmission line.

FIG. 13 shows a cross-sectional view of an example non-propagating waveguide structure 52 formed in a microwave circuit package 50. As shown in FIG. 13, the non-propagating waveguide structure 52 is used to provide high frequency isolation between a microstrip 54 and other components within and without the microwave circuit package 50. The microstrip comprises a conductive metal strip 62 deposited on top of an evenly controlled dielectric 60, which is deposited on top of a metal ground plane 58, which is printed or deposited on top of a substrate 56. In FIG. 13, the non-propagating waveguide structure 52 is formed using an indented cavity in the shielded cover 64. However, the non-propagating waveguide structure may also be formed using the punch and layer method described previously. In FIG. 13, each layer is fused together preferably using the diffusion bonding technique described previously. The width and height of the non-propagating waveguide structure 52 is very small (e.g., on the order of 1–2 mm) in order to ensure an extremely high cutoff frequency (e.g., a waveguide cross-sectional width of a=3 mm cuts off at $f_c=c/2a=(3\times10^{11}$ m/s)/(2a m)=50 GHz, where c is the speed of light).

The non-propagating waveguide structure also provides another advantage over prior art isolation techniques. Traditionally, if high frequency isolation was desired, the microcircuit would be enclosed in a highly conductive cavity. However, this technique was not very effective because the cavities were formed by bolting together metal sheets into a box-like structure and using a highly resistive epoxy to seal the cover. The use of highly resistive epoxy at the joints increases the leakage of the cavity. With the diffusion bonding technique used in the preferred embodiment of the present invention, the cavity may be formed without using the resistive epoxy, thereby maintaining a high isolation factor. Also, due to the difficulty in bolting together small-dimensioned sides of the resonant cavity, most packages have larger-than-desired cavity dimensions, which often results in electromagnetic energy propagation at GHz frequencies that are near the frequencies of the operation of the microcircuit. This results in parallel leakage paths around the microcircuit or component. With the present invention, the non-propagating waveguide structures can be formed to be very small and narrow, and thus to have extremely high cutoff frequencies (i.e., much higher than the frequency of operation of the microcircuit), thereby significantly reducing parallel path leakage around the microcircuit component. The present invention thus eliminates the need for expensive-to-build, bulky shield cavities.

It will be appreciated that the technique of utilizing non-propagating waveguide structures to prevent parallel leakage paths can be extended to provide non-propagating waveguide structures throughout the microwave circuit package to shield each microcircuit component and each microstrip transmission line. Accordingly, various microcircuits and microstrip transmission lines may be embedded into a ceramic substrate, which may be adhered to a metal base plate, and a shielded cover having separate indented cavities, or pockets, for encasing and isolating each of the various components may be fused to the metal base plate to form separate shielded cavities for each microcircuit component and transmission line all within the same package. This extension ensures that the electromagnetic energy is propagated throughout the microwave system inside the microwave circuit package where it is desired to be propagated and without significant leakage, and also provides isolation between circuit elements, transmission lines and the outside world.

It will also be appreciated that the microcircuit component need not be an embedded component. Rather, any embedded waveguide structure may be used to provide shielding isolation of any circuit component whether embedded within the ceramic or not. Also, the method of creating the isolation cavities may be done by fusing shielded cover having indented pockets over various circuit components, or using the punch layer method described previously.

The waveguide structure technique of the present invention may be further extended to form resonant cavities, which are commonly used to function as bandpass filters, for tuning, and for other purposes. Resonant cavities are known in the art and have many uses. The technique of the present invention may be applied to form resonant cavities with desired dimensions for any use.

Figure 14:
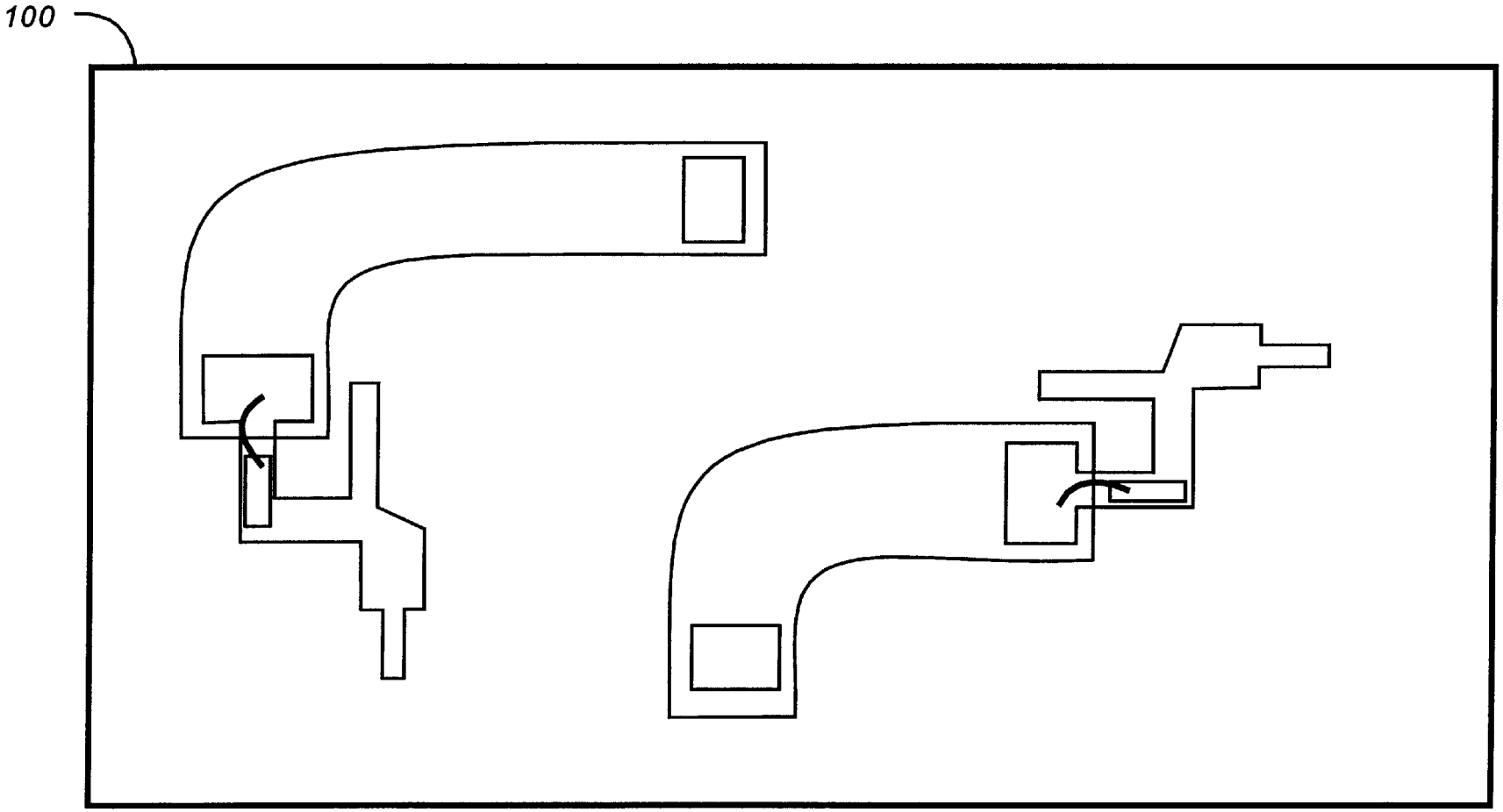
FIG. 14 is a top view of a microwave circuit package with all the layers showing, which illustrates a microwave system implemented in the microwave circuit package which utilizes each of the features provided by the techniques of the present invention.
Figure 15:
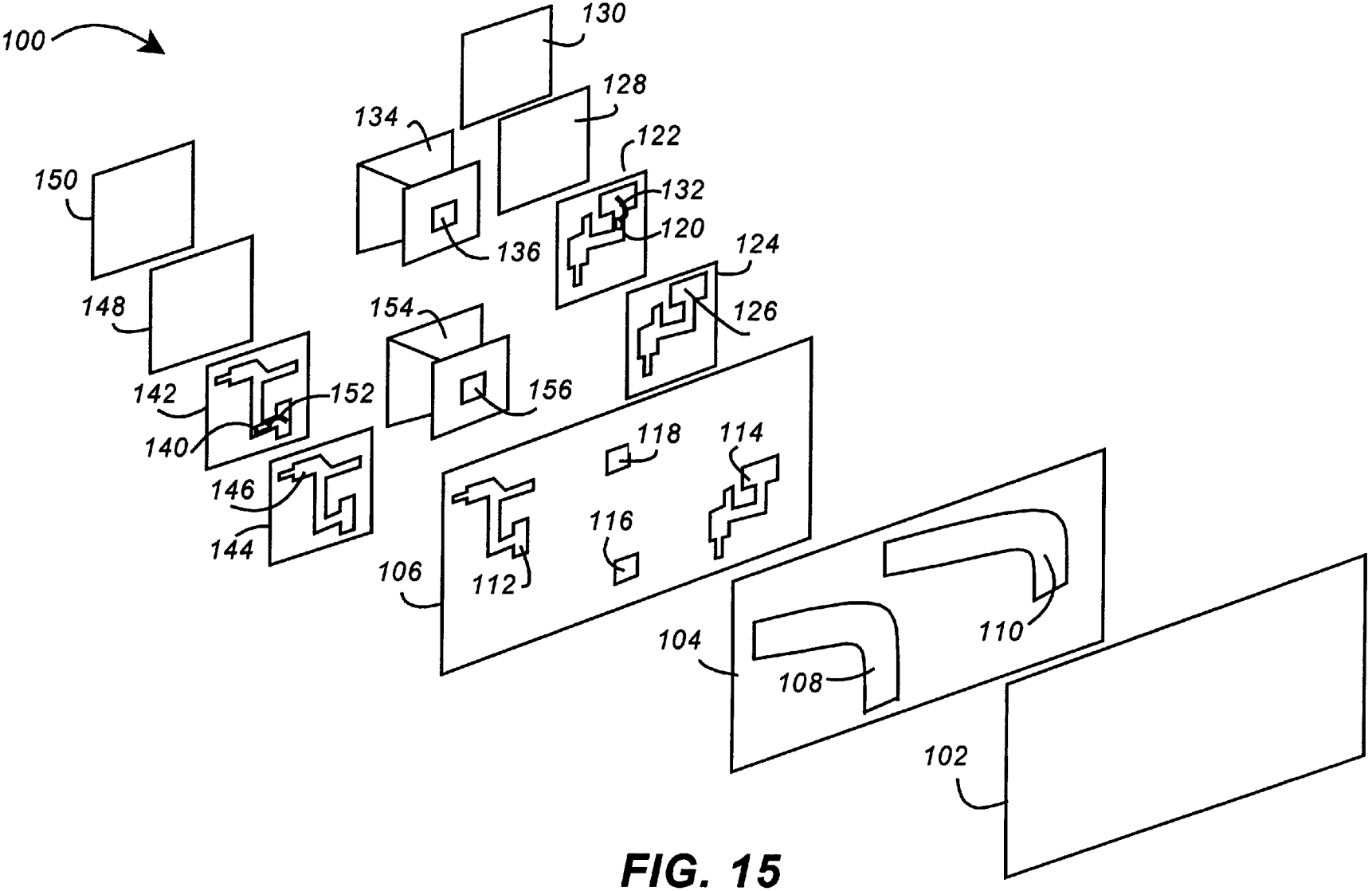
FIG. 15 is an assembly view of the microwave circuit package of FIG. 14.

FIG. 14 and 15 illustrate a microwave system implemented in a microwave circuit package 100 which utilizes each of the features provided by the techniques of the present invention. FIG. 14 is a top view of the microwave circuit package 100 with all the layers showing. The microwave circuit package 100 is a compact receiver/transmitter system. FIG. 15 is an assembly view of the microwave circuit package 100. As shown in FIG. 15, the microwave circuit package 100 is implemented using the punch and layer method described previously. The microwave circuit package 100 is formed by layering, one on top of the other, laminate layer 102, laminate layer 104, and laminate layer 106. Laminate layer 102 acts as the shielded cover and is composed of 0.020" thick copper. Laminate layer 104 has right-angle bend windows 108 and 110 which are used to form propagating waveguide structures for use as transmission lines. In this embodiment, laminate layer 104 is composed of 0.0937" copper. Laminate layer 106 includes windows 112 and 114 which are used to form non-propagating waveguide structures, and windows 116 and 118 which overlap with windows 108 and 110 to form a periscope-type non-planar waveguide when the layers are fused together. In this embodiment, laminate layer 106 is composed of 0.0201" copper. A receiver circuit 120 is mounted to a metal mounting surface 122 which mates to a conductive gasket 124 which has a window 126 that matches the size and shape of window 114. The conductive gasket 124 is fused to laminate layer 106 in a position where window 126 of the conductive gasket 124 and window 114 of laminate layer 106 align. The metal mounting surface 122 is then fused to the conductive gasket 124 in a position where the receiver circuit 120 fits within the window 126 of the conductive gasket 124. The non-propagating waveguide structure formed around receiver circuit 126 by windows 126 and 114 isolates the receiver circuit 120 from the rest of the microwave system both outside and inside the microwave circuit package. Another conductive gasket 128 is then fused to the other side of the metal mounting surface 122, and a ceramic substrate 130 is then adhered to the conductive gasket 128. The receiver circuit 120 has a transition loop 132 which extends from the receiver circuit 120 into the window 126 of the conductive gasket 124. An antenna 134 has an opening 136 which is aligned with window 118 of laminate layer 106 and bolted into position. Window 118 has the same dimensions as the opening 126 of antenna 134. A transmitter circuit 140 is mounted to a metal mounting surface 142 which mates to a conductive gasket 144 which has a window 146 that matches the size and shape of window 112. The conductive gasket 144 is fused to laminate layer 106 in a position where window 146 of the conductive gasket 144 and window 112 of laminate layer 106 align. The metal mounting surface 142 is then fused to the conductive gasket 144 in a position where the transmitter circuit 140 fits within the window 146 of the conductive gasket 144. Another conductive gasket 148 is then fused to the other side of the metal mounting surface 142, and a ceramic substrate 150 is then adhered to the conductive gasket 148. The transmitter circuit 140 has a transition loop 152 which extends from the receiver circuit 140 into the window 146 of the conductive gasket 144. An antenna 154 has an opening 156 which is aligned with window 116 of laminate layer 106 and bolted into position. Window 116 has the same dimensions as the opening 156 of antenna 154.

When all of the layers are fused together with highly conductive material, a pair of propagating waveguide structures are formed by windows 108 and 110 in laminate layer 104, a pair of non-propagating waveguide structures are formed by windows 112 and 114 in laminate layer 106, a pair of microcircuit-to-waveguide launches are formed via wire bond loops 132, 152, and a pair of periscope-type waveguides are formed which pass from the microcircuit layers 122, 142 through the conductive gaskets 124, 144 via respective windows 126, 146 through laminate layer 106 via respective windows 114, 112 into the waveguide structures formed in laminate layer 104 via windows 116, 118 in laminate layer 106, and to/from the antennas 134, 154.

It will be appreciated that the microwave circuit package 100 incorporates both propagating and non-propagating waveguide structures to provide extremely high isolation between circuit components, and also provides a direct microcircuit-to-waveguide launch to external waveguide components (i.e., here it is the antennas). In addition, the microwave circuit package 100 also utilizes a non-planar "periscope"-type waveguide structure to allow the microwave circuit package 100 to be more compact.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A microwave circuit package, comprising:

a base plate comprising a metallic top plane;

a metal laminate plate comprising a top plane, a bottom plane, and a window, said window forming a thruway between said top plane and said bottom plane; and a cover plate comprising a metallic bottom plane;

wherein said bottom plane of said metal laminate plate is fused to said metallic top plane of said base plate and said top plane of said metal laminate plate is fused to said metallic bottom plane of said cover plate to form an imbedded waveguide structure in said microwave circuit package.

2. The microwave circuit package of claim 1, wherein:

said base plate comprises a printed circuit board, said metallic top plane comprising a top conductive foil of said printed circuit board.

3. The microwave circuit package of claim 1, wherein:

said base plate comprises a ceramic substrate, said metallic top plane comprising a highly conductive layer printed on said ceramic substrate.

4. The microwave circuit package of claim 1, wherein:

said metal laminate plate comprises a second window, said second window having dimensions of a receiving opening of an external waveguide component, and forming a thruway between inside said imbedded waveguide structure and outside said microwave circuit package.

5. The microwave circuit package of claim 1, comprising:

a microcircuit component adhered to said base plate;

a wire bond loop coupled to said microcircuit, said wire bond loop being positioned to extend into said imbedded waveguide structure.

6. The microwave circuit package of claim 5, wherein:

said metal laminate plate comprises a window having dimensions of a receiving opening of an external waveguide component and which forms a thruway between inside said imbedded waveguide structure and outside said microwave circuit package.

7. The microwave circuit package of claim 1, wherein one or more microcircuit components which operate at an operating frequency are positioned to reside within said imbedded waveguide structure when said metal laminate plate is fused to said base plate, and wherein said imbedded waveguide structure is constructed to propagate electromagnetic waves only of a frequency greater than a waveguide cutoff frequency, said waveguide cutoff frequency being greater than said operating frequency in order to disallow electromagnetic wave propagation within the imbedded waveguide structure and to reduce parallel path leakage around said microcircuit components.

8. The microwave circuit package of claim 7, wherein said microcircuit components comprise a microstrip.

9. The microwave circuit package of claim 1, said imbedded waveguide structure being used as a resonant cavity.

10. The microwave circuit package of claim 1, wherein:

said metal laminate layer comprises:

a plurality of metal laminate plates fused one on top of another, each comprising a window and each of said windows of said plurality of metal laminate plates aligning to form said thruway between said top plane and said bottom plane of said metal laminate layer.

11. A microwave circuit package, comprising:

a base plate comprising a metallic plane;

a metal cover plate comprising a flat surface and having an indented cavity disposed in said flat surface, wherein said flat surface of said metal cover plate is fused to said metallic plane of said base plate to form an imbedded waveguide structure between said base plate and said metal cover plate, said imbedded waveguide structure formed to propagate electromagnetic waves only of a frequency greater than a waveguide cutoff frequency; and a microcircuit component which operates at an operating frequency below said waveguide cutoff frequency that is positioned to reside within said imbedded waveguide structure to reduce parallel path leakage around said microcircuit component.

12. The microwave circuit package of claim 11, wherein:

said base plate comprises a printed circuit board, said metallic plane comprising a top conductive foil of said printed circuit board.

13. The microwave circuit package of claim 11, wherein:

said base plate comprises a ceramic substrate, said metallic plane comprising a highly conductive layer printed on said ceramic substrate.

14. The microwave circuit package of claim 11, comprising:

a window which forms a thruway between inside said imbedded waveguide structure and outside said microwave circuit package when said metal cover plate and said base plate are fused together, such that a receiving opening of an external waveguide component may be aligned with said window and attached to said microwave circuit package to form an internal-waveguide-to-external-waveguide-component launch.

15. The microwave circuit package of claim 11, comprising:

a microcircuit component adhered to said base plate;

a wire bond loop coupled to said microcircuit, said wire bond loop being positioned to extend into said imbedded waveguide structure.

16. The microwave circuit package of claim 15, comprising:

a window which forms a thruway between inside said imbedded waveguide structure and outside said microwave circuit package when said metal cover plate and said base plate are fused together, such that a receiving opening of an external waveguide component may be aligned with said window and attached to said microwave circuit package to form an internal-waveguide-to-external-waveguide-component launch.

17. The microwave circuit package of claim 11, wherein said microcircuit components comprise a microstrip.

18. The microwave circuit package of claim 11, said imbedded waveguide structure being used as a resonant cavity.

19. A method for forming an imbedded waveguide structure inside a microwave circuit package, comprising:

providing a metal laminate layer, said metal laminate layer comprising a bottom plane;

forming an indented cavity in said bottom plane of said metal laminate layer;

providing a base plate, said base plate comprising a metallic top plane;

fusing said bottom plane of said metal laminate layer to said metallic top plane of said base plate to form said microwave circuit package and said imbedded waveguide structure therein.

20. A method in accordance with claim 19, comprising:

forming said metal laminate layer by:

providing a metal cover plate;

providing at least one metal laminate plates, said at least one metal laminate plates comprising a metal laminate plate window;

fusing said at least one metal laminate plates in a stacked arrangement wherein said metal laminate plate window of each of said at least one metal laminate plates are aligned; and fusing said metal cover plate on top of said fused at least one metal laminate plates.

21. A method in accordance with claim 19, comprising:

coupling a wire bond loop to a microcircuit component; and positioning said wire bond loop to extend into said imbedded waveguide structure when said metal laminate layer is fused to said metallic top plane of said base plate.

22. The method of claim 19, comprising:

providing a window, said window forming a thruway between inside said imbedded waveguide structure and outside said microwave circuit package and having dimensions of a receiving opening of an external waveguide component.

* * * * *